US007125390B2

(12) United States Patent
Ferber et al.

(10) Patent No.: US 7,125,390 B2
(45) Date of Patent: Oct. 24, 2006

(54) WRAP AROUND BODY MASSAGER

(75) Inventors: Roman S. Ferber, West Bloomfield, MI (US); Charles Huang, Taipei (TW); John E. Nemazi, Bloomfield Hills, MI (US); Michael D. Turner, Royal Oak, MI (US)

(73) Assignee: Homedics, Inc., Commerce Township, MI (US)

( * ) Notice: Subject to any disclaimer, the term of this patent is extended or adjusted under 35 U.S.C. 154(b) by 549 days.

(21) Appl. No.: 10/654,560

(22) Filed: Sep. 3, 2003

(65) Prior Publication Data

US 2005/0049529 A1 Mar. 3, 2005

(51) Int. Cl.
*A61H 23/02* (2006.01)

(52) U.S. Cl. ..... 601/101; 601/103; 601/111

(58) Field of Classification Search ..... 601/46, 601/49, 51, 72, 73, 80, 81, 86–90, 93, 94, 601/97, 98, 107, 108, 110, 111
See application file for complete search history.

(56) References Cited

U.S. PATENT DOCUMENTS

| | | | | |
|---|---|---|---|---|
| D775,818 | | 11/1904 | Fornander | |
| 1,098,337 | A | 5/1914 | Soukup | |
| 1,269,803 | A | 6/1918 | Elmen et al. | |
| 1,339,179 | A | 5/1920 | Elmen | |
| 1,377,140 | A | 5/1921 | North | |
| 1,657,765 | A | 1/1928 | Pasque | |
| 1,888,510 | A | 11/1932 | Mashek | |
| 2,138,815 | A | 12/1938 | Eberly | |
| 2,168,975 | A * | 8/1939 | Clarke | 601/138 |
| 2,466,659 | A | 4/1949 | Korpela | |
| 2,964,037 | A | 12/1960 | Johnston | |
| 3,094,119 | A | 6/1963 | Avedissian | |
| 3,467,080 | A | 9/1969 | McNair | |
| 3,536,064 | A | 10/1970 | Kuroda et al. | |
| 3,548,811 | A | 12/1970 | Wilson | |
| 3,626,934 | A | 12/1971 | Andis | |
| 3,672,355 | A | 6/1972 | Ogawa et al. | |
| 3,802,423 | A | 4/1974 | Pfaendler | |
| 3,856,002 | A * | 12/1974 | Matsumoto | 601/137 |
| 3,881,470 | A | 5/1975 | Glore | |
| 4,025,809 | A | 5/1977 | Teranishi | |
| 4,079,733 | A | 3/1978 | Denton et al. | |
| 4,088,128 | A | 5/1978 | Mabuchi | |
| 4,091,805 | A | 5/1978 | Clark | |
| 4,098,266 | A | 7/1978 | Muchisky et al. | |
| 4,106,500 | A | 8/1978 | Burchart | |

(Continued)

FOREIGN PATENT DOCUMENTS

| | | |
|---|---|---|
| CH | 671 333 A5 | 8/1989 |

(Continued)

OTHER PUBLICATIONS

HoMedics, Body Belt "All-Over" Body Massager, Model BT-1000, Instructions and Warranty, © 1996.

*Primary Examiner*—Quang D. Thanh
(74) *Attorney, Agent, or Firm*—Brooks Kushman P.C.

(57) ABSTRACT

The present invention discloses a hand-held body massager having a transverse housing with a massage region. A massage unit is oriented within the housing for parting a massage effect from the massage region. A pair of elongate arms are each pivotally connected to opposed ends of the housing with the massage region oriented therebetween. Each arm includes a handle to be grasped by a user so that the user may urge the massage region against a target surface of the user's body.

23 Claims, 4 Drawing Sheets

U.S. PATENT DOCUMENTS

| | | | | |
|---|---|---|---|---|
| 4,149,530 | A | | 4/1979 | Gow |
| 4,150,668 | A | | 4/1979 | Johnston |
| 4,414,963 | A | | 11/1983 | Kunz |
| 4,433,683 | A | | 2/1984 | McCoy et al. |
| 4,512,339 | A | | 4/1985 | McShirley |
| 4,730,605 | A | | 3/1988 | Noble et al. |
| D299,863 | S | | 2/1989 | Noble et al. |
| 4,827,914 | A | | 5/1989 | Kamazawa |
| 4,878,489 | A | | 11/1989 | Kamayachi |
| 5,065,743 | A | * | 11/1991 | Sutherland ..... 601/134 |
| 5,088,474 | A | | 2/1992 | Mabuchi et al. |
| 5,117,815 | A | | 6/1992 | Gentry et al. |
| 5,123,405 | A | | 6/1992 | McShirley et al. |
| 5,123,406 | A | | 6/1992 | Masuda |
| 5,159,922 | A | | 11/1992 | Mabuchi et al. |
| 5,193,528 | A | | 3/1993 | Iwamoto et al. |
| 5,361,437 | A | | 11/1994 | Zhu et al. |
| 5,447,491 | A | | 9/1995 | Bellandi |
| 5,716,332 | A | | 2/1998 | Noble |
| 5,772,615 | A | | 6/1998 | Elder et al. |
| 5,803,916 | A | | 9/1998 | Kuznets et al. |
| 5,848,980 | A | | 12/1998 | Demerais |
| 5,868,689 | A | | 2/1999 | Faroky et al. |
| 5,923,107 | A | | 7/1999 | Franck |
| 5,935,089 | A | | 8/1999 | Shimizu |
| D415,838 | S | | 10/1999 | Noble |
| 6,033,372 | A | | 3/2000 | Tarbet et al. |
| 6,102,875 | A | | 8/2000 | Jones |
| 6,102,876 | A | | 8/2000 | Winger |
| 6,165,145 | A | | 12/2000 | Noble |
| 6,332,873 | B1 | | 12/2001 | Naruse et al. |
| 6,500,135 | B1 | | 12/2002 | Huang |
| 2003/0009116 | A1 | | 1/2003 | Luettgen et al. |
| 2003/0028134 | A1 | | 2/2003 | Lev et al. |
| 2003/0158505 | A1 | | 8/2003 | Calvert |

FOREIGN PATENT DOCUMENTS

| | | | | |
|---|---|---|---|---|
| DE | 42 07 285 | A1 | | 8/1993 |
| EP | 0001833 | | | 5/1979 |
| GB | 498228 | | | 12/1938 |
| JP | 5-20730 | U | | 3/1993 |
| JP | 5-91676 | U | | 12/1993 |
| JP | 5-345006 | | * | 12/1993 |
| JP | 6-77730 | U | | 11/1994 |
| JP | 7-28549 | U | | 5/1995 |

* cited by examiner

WRAP AROUND BODY MASSAGER

BACKGROUND OF THE INVENTION

1. Field of the Invention

The invention relates to body massagers, particularly to a body massager that can be gripped with two hands by a user.

2. Background Art

Power operated massagers are often used to treat muscle tension and fatigue. Massagers that exert a percussive effect on the body may be preferred over massagers which generate a rubbing action, since the latter type of massager can cause irritation or other discomfort to the recipient. Examples of percussive body massagers include U.S. Pat. No. 6,500,135 B2 issued to same assignee on Dec. 31, 2002 and U.S. Patent Application Publication No. US 2003/0028134 A1 published on Feb. 6, 2003, also assigned to same assignee, which are both incorporated by reference herein.

Prior art massagers typically include an elongate arm or handle to be gripped by a user for orienting the massage elements or region upon a desired target area. Prior art massagers impart a massage effect upon the target area and consequently experience a resultant effect upon the massager. This resultant effect creates a moment upon the elongate arm making it difficult for the user to orient or maintain the orientation of the massage region. This difficulty may also minimize the massage effect experienced by the user if the user cannot firmly maintain the orientation of the massager. This difficulty relates to many massagers of the single arm type, including percussive massagers, vibratory massagers and the like.

The prior art has approached the aforementioned difficulty by providing massagers having a pair of arms, or a unitary arm with a pair of handles with the massage region oriented centrally relative to the handles. Some of these prior art massagers include a rigid pair of arms or a rigid unitary arm that minimizes the applicability of the massager, and does not provide a variety of grasping orientations. Other prior art massagers include a pair of bendable arms extending from the central massaging unit. However, the bendable arms require the user to bias the arms during operation. Thus, the user must exert an effort sufficient to manipulate the orientation of both arms and concurrently overcome the resultant effect imparted upon the massager.

Accordingly, it is a goal of the present invention to provide a simplified, low-cost massager providing more than one ergonomic handle location to be gripped by a user and to be manipulated by the user to a selected orientation relative to the massage unit without requiring a constant bias applied upon the handles to maintain the selected orientation.

SUMMARY OF THE INVENTION

An object of the present invention is to provide a handheld body massager to include a transverse housing having a massage region with a massage unit oriented therein for imparting a massage effect. A pair of elongate arms are each pivotally connected to opposed ends of the housing with the massage region oriented therebetween. Each of these arms has a handle to be grasped by a user and the arms are generally pivotal toward and away from each other. A user may grasp each handle to urge the massage region against a desired surface of the user's body.

Another object of the present invention further defines the massage unit as a percussive massage unit including a motor transversely mounted within the housing. A connecting rod has a first end rotatably connected to an output shaft of the motor at a location eccentrically spaced about the axis of rotation of the output shaft to cause a second end of the connecting rod to reciprocate as the output shaft rotates. An elongated rocker arm is pivotally mounted within the housing and driven by the connecting rod thus causing the rocker arm to pivotally oscillate relative to the housing as the connecting rod second end reciprocates. A pair of spaced apart massage nodes are mounted to the rocker arm and extend from the housing such that the oscillation of the rocker arm creates a percussive massage effect of the massage nodes to be imparted upon a selected region or area of the user's body.

The above objects and other objects, features, aspects and advantages of the present invention are readily apparent from the following detailed description of the preferred embodiment of the invention when taken in connection with the accompanying drawings.

DETAILED DESCRIPTION OF THE PREFERRED EMBODIMENT(S)

Figure 1:
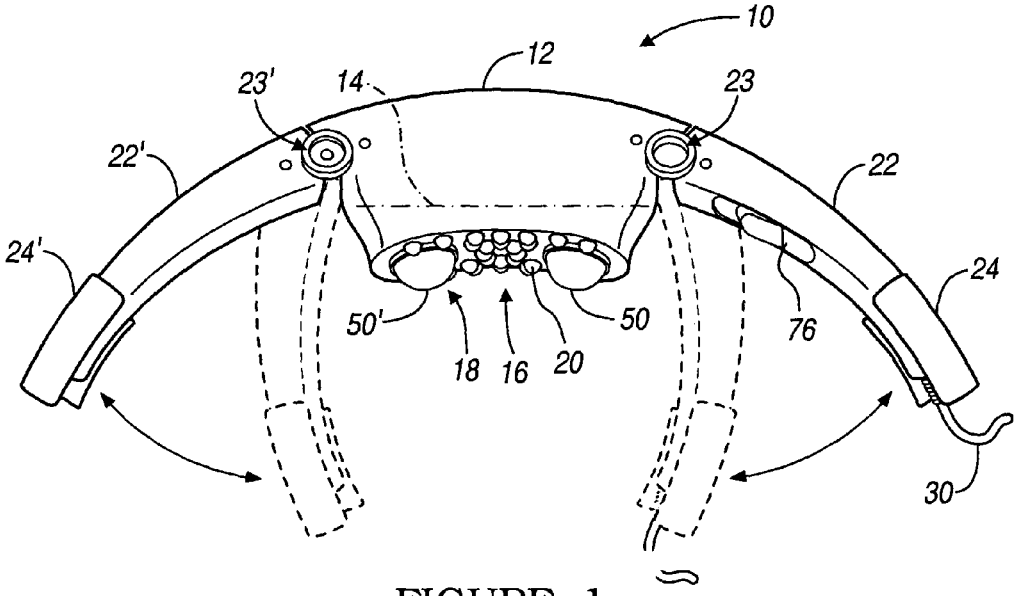
FIG. 1 is a top plan view of a handheld body massager in accordance with the present invention, the massager having a pair of elongate arms, each being illustrated in a first orientation and each being illustrated in phantom at another orientation relative to the massager.

Referring to FIG. 1, a preferred embodiment wrap around body massager is illustrated and referenced generally by numeral 10. The massager 10 includes a transverse housing 12 having a central axis 14 and a massage region 16. The massage region 16 includes a massage unit 18 that is oriented within the transverse housing 12 and partially extends therefrom for imparting a massage effect to the massage region 16. The massage region 16 also includes a plurality of massage projections 20 that are fixed to the housing 12 for providing an additional massage effect to that of the massage unit 18 as the housing 12 is translated relative to the user's body.

The wrap around body massager 10 is a handheld body massager and includes a pair of elongate arms 22, 22' each pivotally connected at pivotal connections 23, 23' to opposed ends of the housing 12 such that the massage region 16 is oriented between the arms 22, 22'. Each arm 22, 22' includes a handle 24, 24' to be grasped by the user. The arms 22, 22' each pivot relative to the housing such that the handles 24, 24' are generally pivotal toward and away from each other so that a user may grasp each handle 24, 24' to urge the massage region 16 against a selected surface of the user's body.

In comparison to prior art massagers that have the unitary arm with the massage region oriented centrally, or in comparison to prior art massagers having a pair of fixed handles extending from opposed sides of the massage region, the massager 10 of the present invention provides adjustability, such that the user may orient each arm ergonomically while maintaining the orientation of the massage region 16. For example, if a user desired to massage an upper region of the user's back, the user could grasp each handle 24, 24' in the orientation illustrated in solid for performing this operation. Additionally, if a user wanted to orient the massage region 16 upon a lower region of the back or about a limb such as a leg, the user may grasp each handle 24, 24' and urge the arms 22,22' into the orientation illustrated in phantom in FIG. 1.

In comparison to prior art massagers that have a pair of arms that are bendable relative to the massage region, the massager 10 of the present invention requires the user to exert an effort upon the arms 22, 22' initially to orient them in desired orientation, such as that illustrated in phantom, and subsequently little or no force is required to maintain the orientation, wherein the prior art massagers with bendable arms require a constant application of force to maintain the manipulation against the free orientation of the arms of the massager. Additionally, the massager 10 of the present invention provides a generally rigid relationship from the handles 24, 24' through the arms 22, 22' to the massage region 16 so that the user may maintain the orientation of the massage region 16 against a resultant effect imparted upon the transverse housing 12 due to the massage effect from the massage unit 18.

Figure 2:
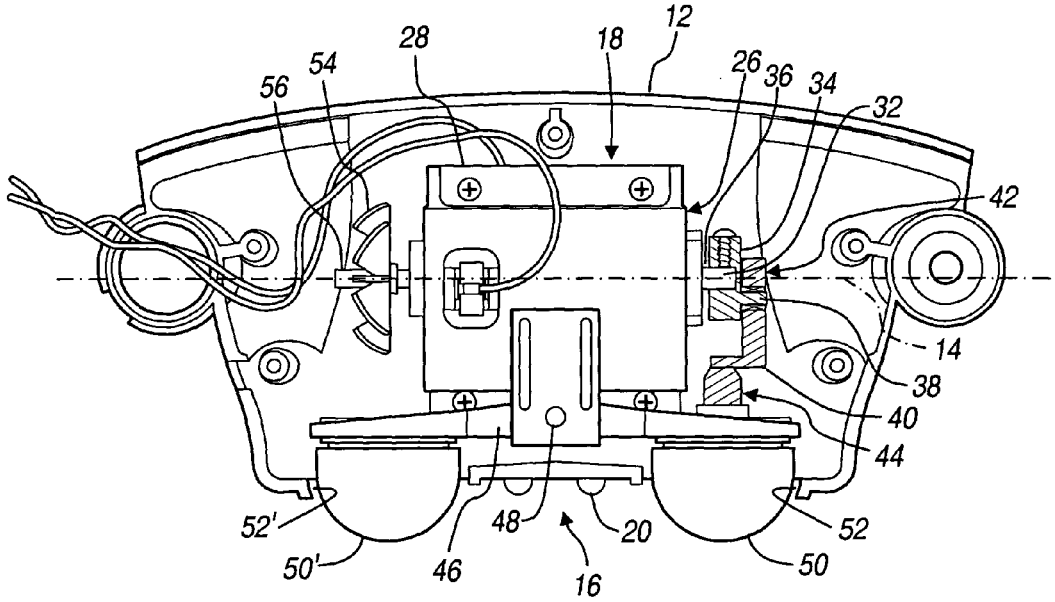
FIG. 2 is a partial section plan view of the massager of FIG. 1.
Figure 4:
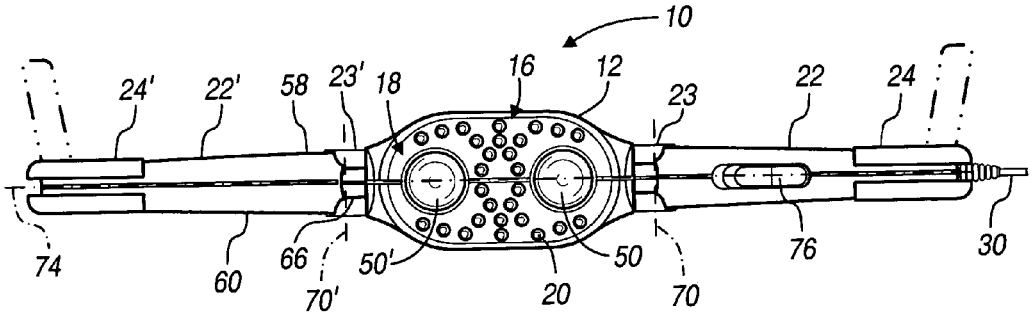
FIG. 4 is a front elevation view of the massager of FIG. 1.

Referring now to FIG. 2, the transverse housing 12 of the massager 10 is illustrated in partial section view providing greater detail to the massage unit 18. Massage unit 18 is further defined as a percussive massage unit, however the invention contemplates various massage units other than the percussive type. The percussive massage unit 18 includes a motor 26, preferably an electric motor that is affixed within the housing 12 by a motor mount 28. The motor 26 is supplied with power through wiring that extends from the motor 26 through the arm 22 to an electrical cord 30, which extends from the arm 22 (as shown in FIGS. 1 and 4).

The motor 26 is mounted transversely within the housing 12 and includes a rotary output shaft 32 extending from both distal ends of the motor 26. A crank arm 34 is affixed to a first end 36 of the output shaft 32 and is rotationally driven thereby. The crank arm 34 has an eccentric output shaft 38 extending therefrom in a radial offset orientation relative to the central axis of the rotary output shaft 32, which is depicted and illustrated also as the central axis 14 of the transverse housing 12. Thus, as rotation is imparted from the motor 26 to the rotary output shaft 32, the crank arm 34 rotates about central axis 14 and the eccentric output shaft 38 revolves about the central axis 14. A connecting rod 40 has a first end 42 rotatably connected to the eccentric output shaft 38. Connecting rod 40 also has a second end 44 operably connected to an elongated rocker arm 46. Preferably the second end 44 is connected to the rocker arm 46 in a flexible manner, for example with a rubber stud, as taught it assignee's U.S. Pat. No. 6,500,135 B2, which has been incorporated by reference.

The rocker arm 46 is pivotally mounted within the housing 12 for oscillation about a central pivotal connection 48 that is parallel with the pivotal connections 23, 23' of the arms 22, 22'. As the crank arm 34 drives the connecting rod first end 42, the connecting rod second end 44 reciprocates relative to the housing 12 thus driving the rocker arm 46 in an oscillatory manner. The rocker arm 46 includes a pair of transversely spaced hemispherical massage nodes 50, 50', which at least partially project from the housing 12 through a pair of transversely spaced apertures 52, 52' formed through the massage region 16 of the housing 12. Therefore, as the rocker arm 46 is driven in the oscillatory manner, the massage nodes 50, 50', each move toward and away from the housing 12 for providing the percussive massage effect.

If it is desired to adjust the massage node spacing, the features of application US 2003/0028134 A1, which has been incorporated by reference, could be utilized in combination with the teachings of the present invention. Further, if flexible sleeves are desired at the apertures 52, 52' of the housing 12, or if interchangeable massage nodes are preferred, Assignee's U.S. Pat. No. 6,500,135 B2 teaches these features.

A fan 54 is mounted to a second end 56 of the motor output shaft 32. Thus, as the motor 26 rotates and provides the percussive massage effect through the components of the percussive massage unit 18, the fan 54 rotates for passing air over the motor 26 and thereby cooling it. Air may travel through the apertures 52, 52' formed through the housing 12, or through additional vents or openings provided in the housing 12 to facilitate this cooling. Alternatively, the percussive massage unit 18 may include a second eccentric drive and a second connecting rod. The advantages and features of this alternative are disclosed in U.S. Pat. No. 6,500,135 B2 and US 2003/00280134 A1, which have been incorporated by reference.

Figure 3:
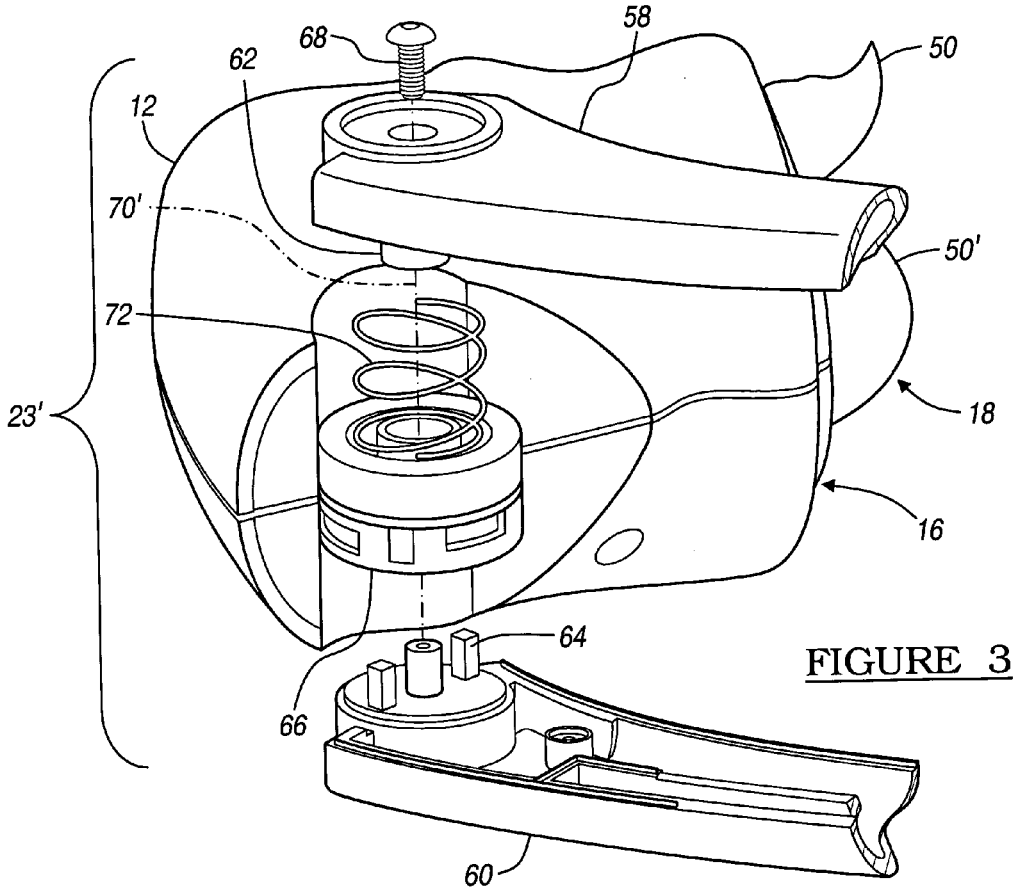
FIG. 3 is a left side partially exploded perspective view of the massager of FIG. 1.

Referring now to FIG. 3, the pivotal connection 23' between the arm 22' and the housing 12 is illustrated in further detail as the arm 22' is illustrated partially exploded. The arm 22' includes a top clam shell portion 58 and a bottom clam shell portion 60, each having pivotal projections 62, 64 respectively sized to be received within a hinge 66 extending transversely from the housing 12. The top and bottom clam shell portions 58, 60 of the arm 22' are preferably formed from an injection molded plastic and are fastened together by a series of fasteners located along the length of the arm 22'. One such fastener 68 is illustrated in FIG. 3 as being coaxial with a pivotal axis 70' about which the arm 22' pivots. The fasteners 68 secure the top and bottom clam shell portions 58, 60 of the arm 22' and secure the arm 22' to the hinge 66 of the housing 12.

As illustrated in FIG. 4, the pivotal axis 70' of the arm 22' is generally parallel with a pivotal axis 70 of the other pivotal connection 23 and the pivotal axes are orthogonal to the housing central axis 14. Further, the pivotal axes 70, 70' lie in a plane that is generally parallel with the massage region 16.

Referring again to FIG. 3, the pivotal connection 23' may also include a compression spring 72 that is received between the hinge 66 and the top clam shell portion 58 of the arm 22'. Upon assembly of the arm 22', the top clam shell portion 58 compresses the spring 72, thus imparting a frictional force upon the top clam shell portion 58. The spring 72 is also fixed for rotation relative to the hinge 66. The cooperation of the hinge 66, the spring 72 and the top clam shell portion 58 act as a clutch for maintaining a selected pivotal orientation of the arm 22' relative to the housing 12. Thus, if the user manipulates the arm 22' to a desired orientation, the user must overcome the frictional force within the pivotal connection 23' provided by the clutch. Once a user selected orientation is obtained, the orientation is maintained by the clutch until the frictional force of the clutch is overcome by an urge applied to the arm 22'.

Another feature of the pivotal connection 23' includes a radial stop (not shown) oriented within the hinge 66 for cooperating with the projections 64 of the lower clam shell portion 60. The radial stop limits the pivotal orientation of the arm 22' relative to the housing 12. This range of motion is illustrated by the solid and phantom orientation of the arms 22, 22' in FIG. 1.

Accordingly, both arms 22, 22' include top and bottom clam shell portions with an enclosed spring, for providing a clutch, and a radial stop for establishing the pivotal range.

Referring now to FIG. 4, the massager 10 of the present invention is illustrated from a front elevation view. A central plane 74 is illustrated generally as a center line in FIG. 4, the central plane 74 bisects the massager 10 and is generally orthogonal to the massage region 16. The transverse housing 12 and the arms 22, 22' collectively define a U-shaped housing that lies in the central plane 74. Accordingly, the housing 12 and the arms 22, 22' all generally have seams that are generally coplanar and lie on the central plane 74. This design results in a structurally sound massager 10 that is simplified and relatively low cost to manufacture, and is relatively compact for minimalizing costs incurred in packaging and shipping.

The arm 22 includes a power switch 76 mounted thereon and wired in series with the wiring from the motor 26 to the electrical cord 30 for controlling the operation of the massage unit 18.

Figure 5:
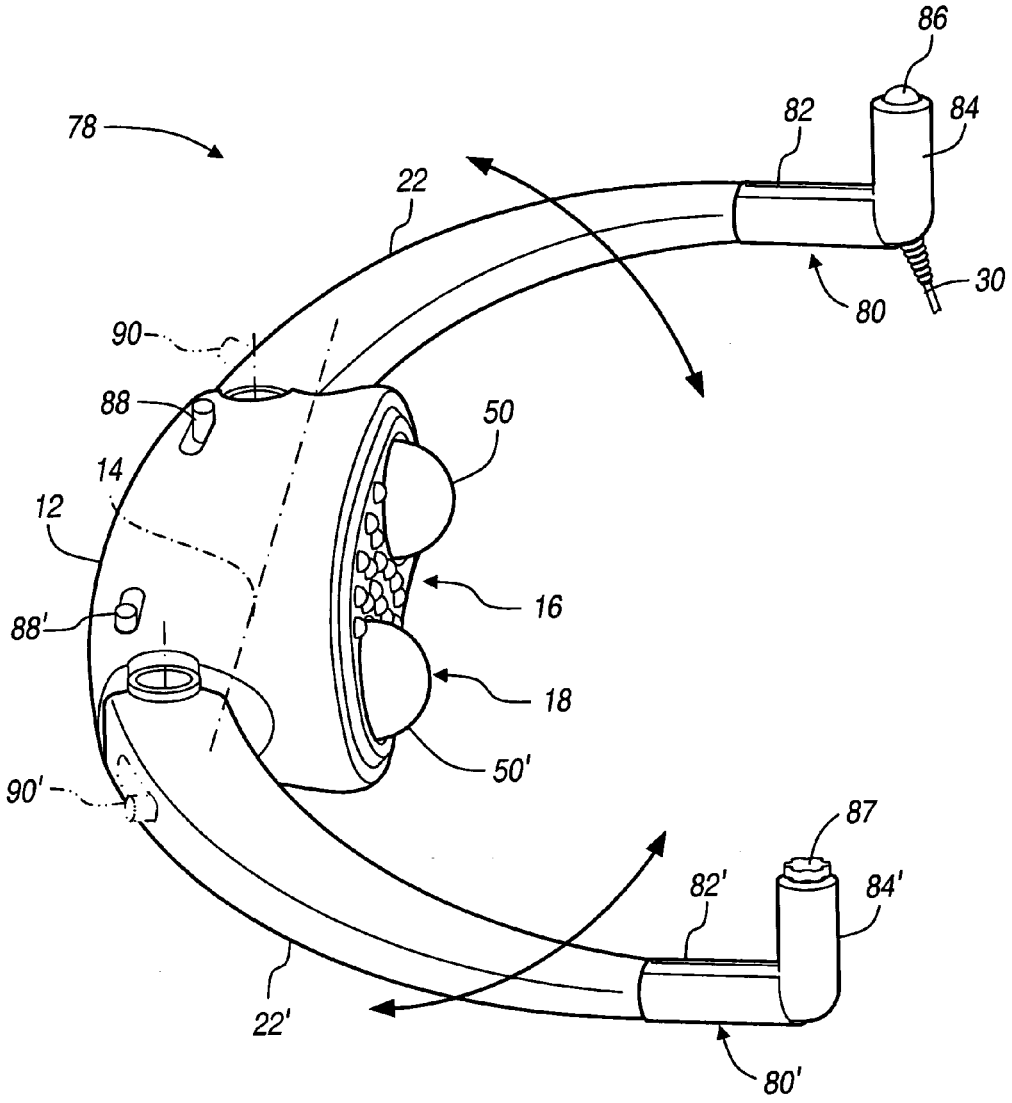
FIG. 5 is a left side quartering perspective view of an alternative embodiment massager in accordance with the present invention.

Referring now to FIG. 5, an alternative embodiment wrap around massager 78 is illustrated. While similar elements retain the same reference numerals, new elements are assigned new reference numerals. The massager 78 includes a pair of arms 22, 22' that each include a handle 80, 80' that has a first grip portion 82, 82' and a second grip portion 84, 84'. The first grip portion 82, 82' is similar to the grip portion of the handle 24 of the preferred embodiment massager 10, the first grip portion 82, 82' being generally coaxial with the arm 22. The second grip portion 84, 84' is generally orthogonal to the first grip portion 82, 82' to provide the user with an alternative grip orientation thus improving ergonomics and allowing the user to determine grip placement. The handles 80, 80' of the alternative embodiment massager 78 are also illustrated in phantom in FIG. 4 for the sake of comparison with the preferred embodiment massager 10.

Figure 6:
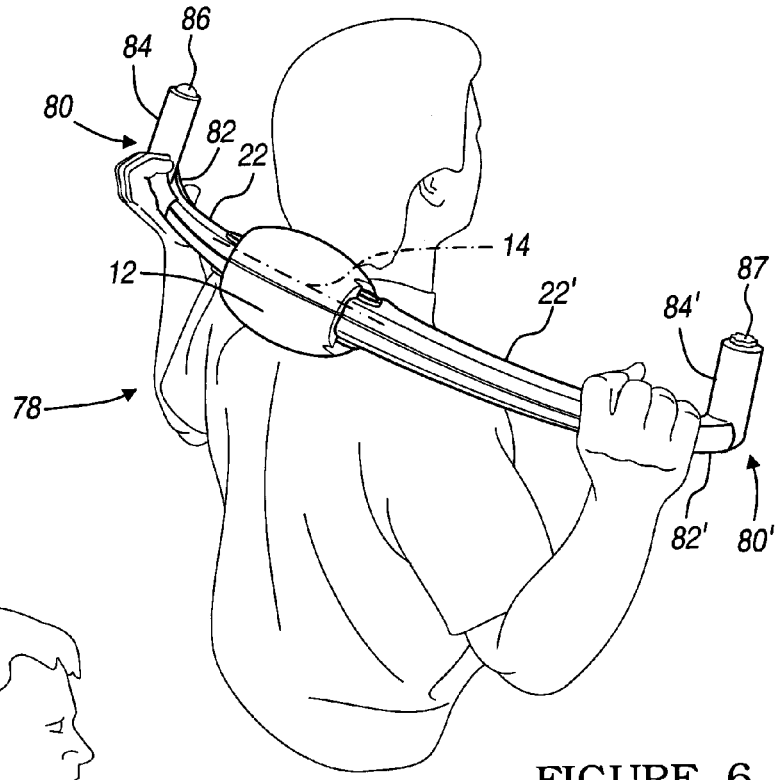
FIG. 6 is a rear perspective view of the massager of FIG. 5, illustrated in operation by a user at an orientation of the massager.
Figure 7:
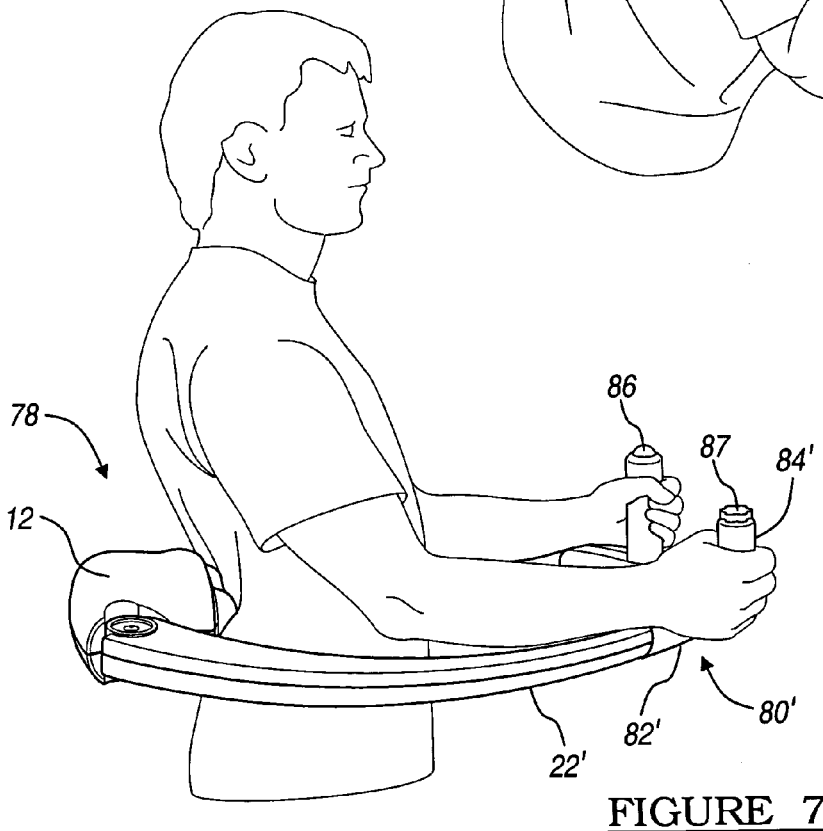
FIG. 7 is a left side view of the massager of FIG. 5, illustrated in operation by the user at another orientation of the massager.

Examples of use in operation of the first and second grip portions 82, 82' and 84, 84' respectively are illustrated in FIGS. 6 and 7. In FIG. 6, the massager 78 is illustrated as utilized for massaging an upper region of the back, as previously described with reference to the preferred embodiment. Accordingly, the user pulls on the handles in order to maintain the massage effect of the massager upon this target region. Thus, the user is utilizing the first grip portions 82, 82' of the handles 80, 80'. In FIG. 7, the user is illustrated utilizing the massager 78 for massaging the lower region of the back. This orientation was also discussed with reference to the preferred embodiment. However, rather than gripping the first grip portions 82, 82' and pulling the massage unit 18 towards the target region, the user may grasp the second grip portions 84, 84' and push the housing 12 towards the target area. This alternative gripping orientation may be more ergonomic than grasping the first grip portions 82, 82' because it provides a more natural orientation of the hand and wrist relative to the arm of the user.

Referring again to FIG. 5, the massager 78 includes a power switch 86 that is located at a distal end of the second grip portion 84. In this location, the power switch 86 is located outside of the grip portions, which receive hand placement of the user. The power switch 86 location is also proximate to the grip portions for ease and use in operation. The opposed handle 82' includes an alternate control switch 87 for regulating another feature such as speed, node spacing, etc.

The transverse housing 12 also includes a pair of locking configurations 88, 88' that extend from the housing 12 and cooperate with the arms 22, 22' respectively such that the user may select an orientation of each arm relative to the housing 12 and thus secure this orientation by locking the respective arm pivotally. In comparison to the preferred embodiment 10, the locking configuration provides a more robust mechanism for maintaining the pivotal orientation than provided by the clutch. Alternatively, each arm 22, 22' may include a locking configuration 90, 90' as illustrated in phantom for locking the respective arms at a pivotal orientation relative to the housing 12. However, location of the locking configurations 88, 88' within the housing 12 may provide for a more robust design and may provide more distinct locking orientations than provided by the optional locking configuration 90, 90' oriented within the arms 22, 22'.

In summary, the present invention wrap around body massager provides a massager that is more ergonomic, simplified, and provides adjustability to the user without requiring a constant effort by the user to maintain the manipulation of the arms in comparison to the prior art. The massager is also compact and relatively achievable by known practices in manufacturing and may be provided to consumers at a cost comparable to that of prior art massagers.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A handheld body massager comprising:

a transverse housing having a central axis and a massage region;

a massage unit having a motorized eccentric drive oriented within the housing for driving a massage formation extending from the housing for reciprocation relative to the housing, thereby imparting a massage effect from the massage region; and a pair of elongate arms pivotally connected to opposed transverse ends of the housing, such that the massage region is oriented therebetween, each arm having a handle to be grasped by a user and being pivotal generally toward and away from each other;

whereby the user may grasp each handle to urge the massage region against a surface of the user's body.

2. The massager of claim 1, wherein each arm pivots about an axis, and the pair of pivotal axes are generally parallel with each other and orthogonal to the housing central axis.

3. The massager of claim 1, wherein each arm pivots about an axis, and the pair of pivotal axes are generally parallel with each other and are lying in a plane that is generally parallel with the massage region.

4. The massager of claim 1, wherein the pivotal connection of each arm to the housing includes a clutch for maintaining an orientation of the arm relative to the housing.

5. The massager of claim 1, further comprising a locking configuration for cooperating with the housing and at least one of the arms for selectively maintaining a pivotal orientation of the arm relative to the housing.

6. The massager of claim 1, wherein one of the arms includes a power switch operating in communication with the massage unit for regulating power to the massage unit.

7. The massager of claim 1, wherein each handle has a first grip portion and a second grip portion for permitting a user to select a desired grip orientation.

8. The massager of claim 7, wherein the first grip portion of each handle is generally orthogonal to the corresponding second grip portion.

9. The massager of claim 7, wherein the first grip portion of each handle is generally coaxial with the corresponding elongate arm.

10. The massager of claim 7, wherein the second grip portion of each handle is not parallel with the corresponding first grip portion.

11. The massager of claim 7, wherein the first grip portion of each handle is generally coaxial with the corresponding elongate arm, and generally orthogonal to the corresponding second grip portion, so that the user may grasp the first grip portion of each handle to pull the massage region against a surface of the user's body, and the user may grasp the second grip portion of each handle to push the massage region against a surface of the user's body.

12. The massager of claim 1, further comprising an elongated rocker arm pivotally mounted to the housing for supporting the massage formation thereon, the rocker arm being operably driven by the eccentric drive.

13. The massager of claim 1, wherein the motorized eccentric drive further comprises a motor mounted within the housing, the motor having a rotary output shaft, and a connecting rod having a first end rotatably connected to the output shaft at a location eccentrically spaced about the axis of rotation of the output shaft to cause a second end of the connecting rod to reciprocate as the output shaft rotates, the second end of the connecting rod being connected to the massage formation.

14. A handheld body massager comprising:

a generally U-shaped housing generally lying in a central plane, the housing having a central portion with an inward facing massage region, and a pair of elongate arms, each including a handle at a distal end of the arm; and a massage unit having a motorized eccentric drive oriented within the housing central portion for driving a massage formation extending from the housing for reciprocation relative to the housing, thereby imparting a massage effect to the massage region;

wherein each arm is connected to the housing central portion by a hinge for pivotal movement about an axis that is generally orthogonal to the central plane, so that a user may grasp each handle for urging the massage region against a surface of the user's body.

15. The massager of claim 14, wherein the massage region is generally orthogonal to the central plane.

16. The massager of claim 14, wherein the handle of each arm extends upwardly out of the central plane to enable the user to urge the massage region toward the user's lower back with minimal wrist flexing.

17. The massager of claim 14, wherein each handle is generally orthogonal to the central plane.

18. The massager of claim 14, further comprising a pair of lock members to releasably fix the arms relative to the housing for preventing rotation at the pivot joint.

19. The massager of claim 14, further comprising controls for the massage unit located within at least one of the handles.

20. The massager of claim 19, wherein the controls operate an on/off feature and a variable speed control.

21. The massager of claim 14, further comprising an elongated rocker arm pivotally mounted to the housing for supporting the massage formation thereon, the rocker arm being operably driven by the eccentric drive.

22. The massager of claim 14, wherein the motorized eccentric drive further comprises a motor mounted within the housing, the motor having a rotary output shaft, and a connecting rod having a first end rotatably connected to the output shaft at a location eccentrically spaced about the axis of rotation of the output shaft to cause a second end of the connecting rod to reciprocate as the output shaft rotates, the second end of the connecting rod being connected to the massage formation.

23. A handheld body massager comprising:

a transverse housing having a central axis and a massage region;

a massage unit oriented within the housing for imparting a massage effect from the massage region; and a pair of elongate arms pivotally connected to opposed transverse ends of the housing, such that the massage region is oriented therebetween, each arm having a handle to be grasped by a user and being pivotal generally toward and away from each other;

whereby the user may grasp each handle to urge the massage region against a surface of the user's body; and wherein the massage unit is further defined as a percussive massage unit comprising:

a motor transversely mounted within the housing, the motor having a rotary output shaft;

a connecting rod having a first end rotatably connected to the output shaft at a location eccentrically spaced about the axis of rotation of the output shaft to cause a second end of the connecting rod to reciprocate as the output shaft rotates;

an elongated rocker arm having a central pivot axis, wherein the rocker arm is pivotally mounted to the housing, the rocker arm being operably connected to the second end of the connecting rod; and a pair of transversely spaced apart massage nodes, which at least partially project from the housing through a pair of transversely spaced apertures formed through the massage region of the housing, each massage node being operably connected to the rocker arm;

wherein the massage nodes move toward and away from the housing for providing a percussive massage effect in response to rotation of the output shaft.

* * * * *